US008869672B2

(12) United States Patent
Smith

(10) Patent No.: US 8,869,672 B2
(45) Date of Patent: Oct. 28, 2014

(54) DUAL FEED ASSAULT RIFLE

(76) Inventor: Kevin T. Smith, Clovis, NM (US)

( * ) Notice: Subject to any disclaimer, the term of this patent is extended or adjusted under 35 U.S.C. 154(b) by 0 days.

(21) Appl. No.: 13/548,312

(22) Filed: Jul. 13, 2012

(65) Prior Publication Data

US 2013/0047828 A1 Feb. 28, 2013

Related U.S. Application Data

(60) Provisional application No. 61/527,370, filed on Aug. 25, 2011.

(51) Int. Cl.

| | |
|---|---|
| ***F41A 9/79*** | (2006.01) |
| ***F41A 9/64*** | (2006.01) |
| ***F41A 9/01*** | (2006.01) |
| ***F41A 9/34*** | (2006.01) |
| ***F41A 9/37*** | (2006.01) |

(52) U.S. Cl.

CPC ... *F41A 9/01* (2013.01); *F41A 9/34* (2013.01); *F41A 9/37* (2013.01)

USPC ..... 89/33.14; 89/33.5

(58) Field of Classification Search

USPC ..... 89/33.01, 33.04, 33.1, 33.14, 33.5

See application file for complete search history.

(56) References Cited

U.S. PATENT DOCUMENTS

| | | | | |
|---|---|---|---|---|
| 3,035,495 | A | 5/1962 | Stoner | |
| 3,198,076 | A * | 8/1965 | Stoner | 89/128 |
| 3,425,317 | A | 2/1969 | Menneking | |
| 3,455,204 | A * | 7/1969 | Stoner | 89/33.2 |
| 3,500,718 | A * | 3/1970 | Stoner | 89/138 |
| 3,662,646 | A * | 5/1972 | O'Brien et al. | 89/33.04 |
| 3,680,432 | A * | 8/1972 | Rocha | 89/33.04 |
| 3,688,640 | A | 9/1972 | Seecamp | |
| 3,744,371 | A | 7/1973 | McFarland | |
| 4,015,511 | A * | 4/1977 | Folsom et al. | 89/33.04 |
| 4,112,817 | A * | 9/1978 | Bourlet | 89/33.1 |
| 4,311,081 | A * | 1/1982 | Gillum | 89/33.04 |
| 4,397,216 | A * | 8/1983 | Tassie | 89/33.04 |
| 4,579,034 | A | 4/1986 | Holloway | |
| 4,612,843 | A * | 9/1986 | Marcon et al. | 89/33.04 |
| 4,665,793 | A * | 5/1987 | Cleary et al. | 89/33.04 |
| 4,942,802 | A | 7/1990 | Stoner | |
| 5,117,735 | A | 6/1992 | Flashkes | |
| 6,634,274 | B1 | 10/2003 | Herring | |
| 7,562,614 | B2 | 7/2009 | Polston | |
| 7,568,421 | B2 * | 8/2009 | Cummings | 89/33.2 |
| 7,597,039 | B2 | 10/2009 | Stussak et al. | |
| 7,806,039 | B1 | 10/2010 | Gomez | |
| 8,136,440 | B1 * | 3/2012 | Shirts et al. | 89/33.14 |

* cited by examiner

*Primary Examiner* — Bret Hayes

(74) *Attorney, Agent, or Firm* — Warner Norcross & Judd LLP

(57) ABSTRACT

A feed assembly of an assault rifle for feeding rounds of ammunition to a firing chamber includes an ammunition feed that is cooperable with the firing chamber. The ammunition feed simultaneously receives a magazine biased to deliver rounds of ammunition to the firing chamber and a belt feed system for feeding belted rounds of ammunition to the firing chamber. A selector is interconnected to a pawl and a magazine cover. The selector simultaneously actuates the pawl and the magazine cover alternately opening and closing the pawl and the magazine cover for selectively feeding rounds of ammunition from the belt feed system or the magazine into the firing chamber.

9 Claims, 4 Drawing Sheets

DUAL FEED ASSAULT RIFLE

This application claims priority to U.S. Provisional Patent Application No. 61/527,370 filed Aug. 25, 2011.

BACKGROUND

The present invention relates generally to a firearm. More specifically, the present invention relates toward an assault rifle capable of receiving rounds of ammunition from both a belt feed system and a cartridge.

Assault rifles such as, for example, the M-16 rifle, are generally configured to introduce ammunition from either a magazine or a belt feed system that makes use of an ammunition box. Existing assault rifles introduce rounds of ammunition to a firing chamber through machine rapid fire by way of a belt feed system, which are known to be mounted on various military vehicles. Alternatively, assault rifles make use of a magazine to introduce ammunition to the firing chamber when the rifle is intended for hand held use in a more mobile theater.

An adaptive assault rifle that provides either rapid fire by way of belt feed system or from a single fire mode by way of a magazine has not yet been developed. Furthermore, rapidly switching between these two feed systems making use of a light weight feed system has also not yet been developed.

Therefore, it would be desirable to provide an assault rifle that is lightweight and easily switched between rapid fire and single fire to provide a more adaptive weapon for various uses.

SUMMARY

A feed assembly of an assault rifle for feeding rounds of ammunition to a firing chamber is disclosed. An ammunition feed is cooperable with the firing chamber. The ammunition feed simultaneously receives a magazine biased to deliver rounds of ammunition to the firing chamber and a belt feed system for feeding belted rounds of ammunition to the firing chamber. A selector is interconnected to a pawl and magazine cover. The selector simultaneously actuates the pawl and the cartridge cover alternately opening and closing the pawl and the cartridge cover for selectively feeding rounds of ammunition from the belt feed system or the cartridge into the firing chamber of the assault rifle.

The present invention solves the problems associated with the prior art feed systems. The inventive pawl and cartridge cover substantially reduce the weight of the feed system allowing the assault rifle to easily be mounted for stationary use during which feeding rounds of ammunition from the belt feed system is preferable. Alternatively, due to the light weight of the feed system, the assault rifle is easily used in mobile situations where it is desirable to feed rounds of ammunition from the cartridge.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF A PREFERRED EMBODIMENT

Figure 1:
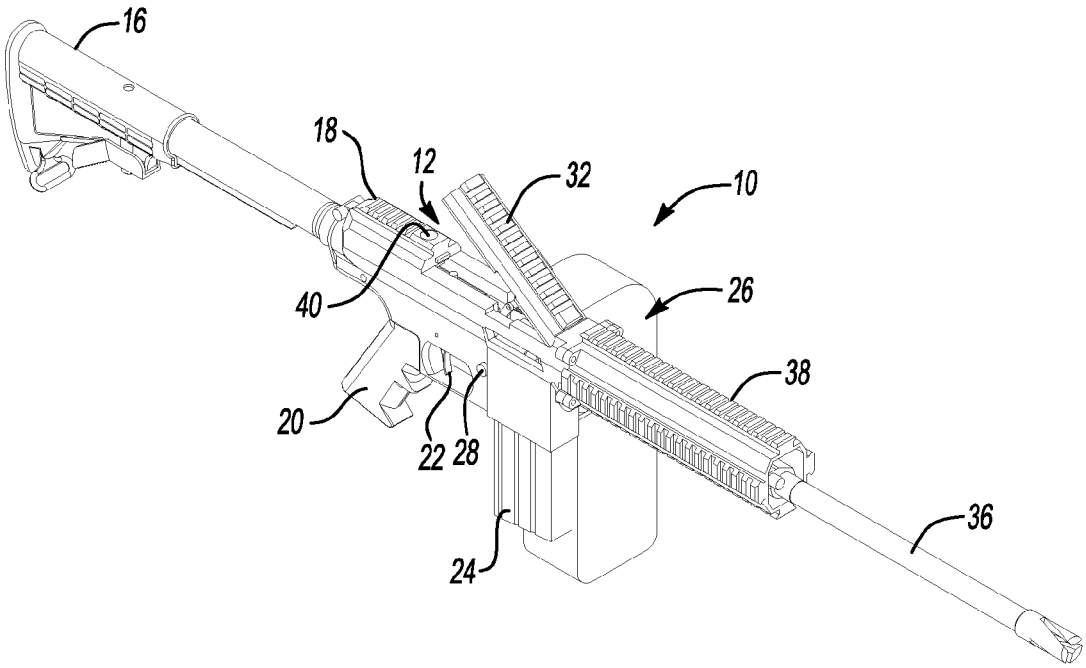
FIG. 1 shows a perspective view of the assault rifle and assembly of the present invention.
Figure 2:
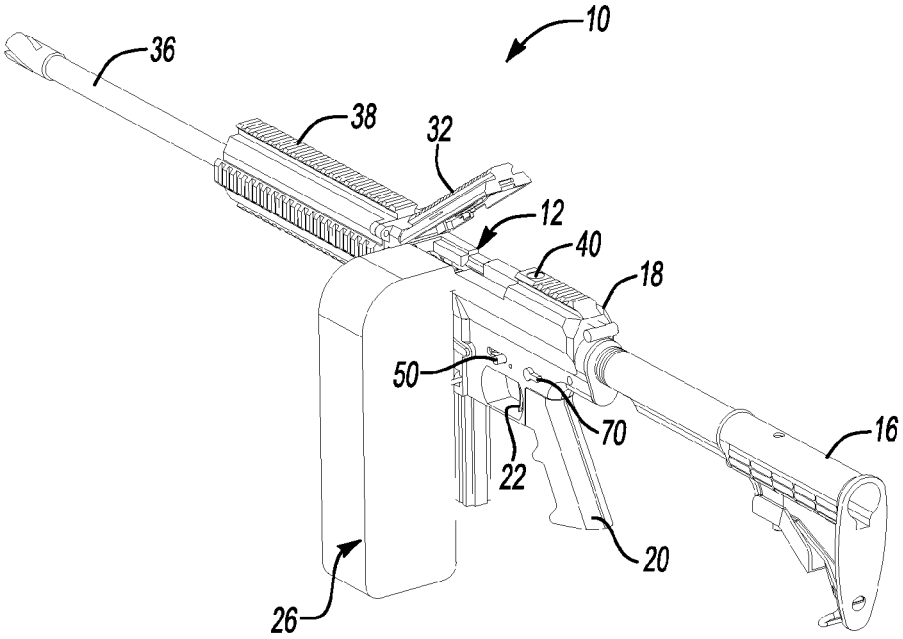
FIG. 2 shows an alternative perspective view of the assault rifle of the present invention.
Figure 3:
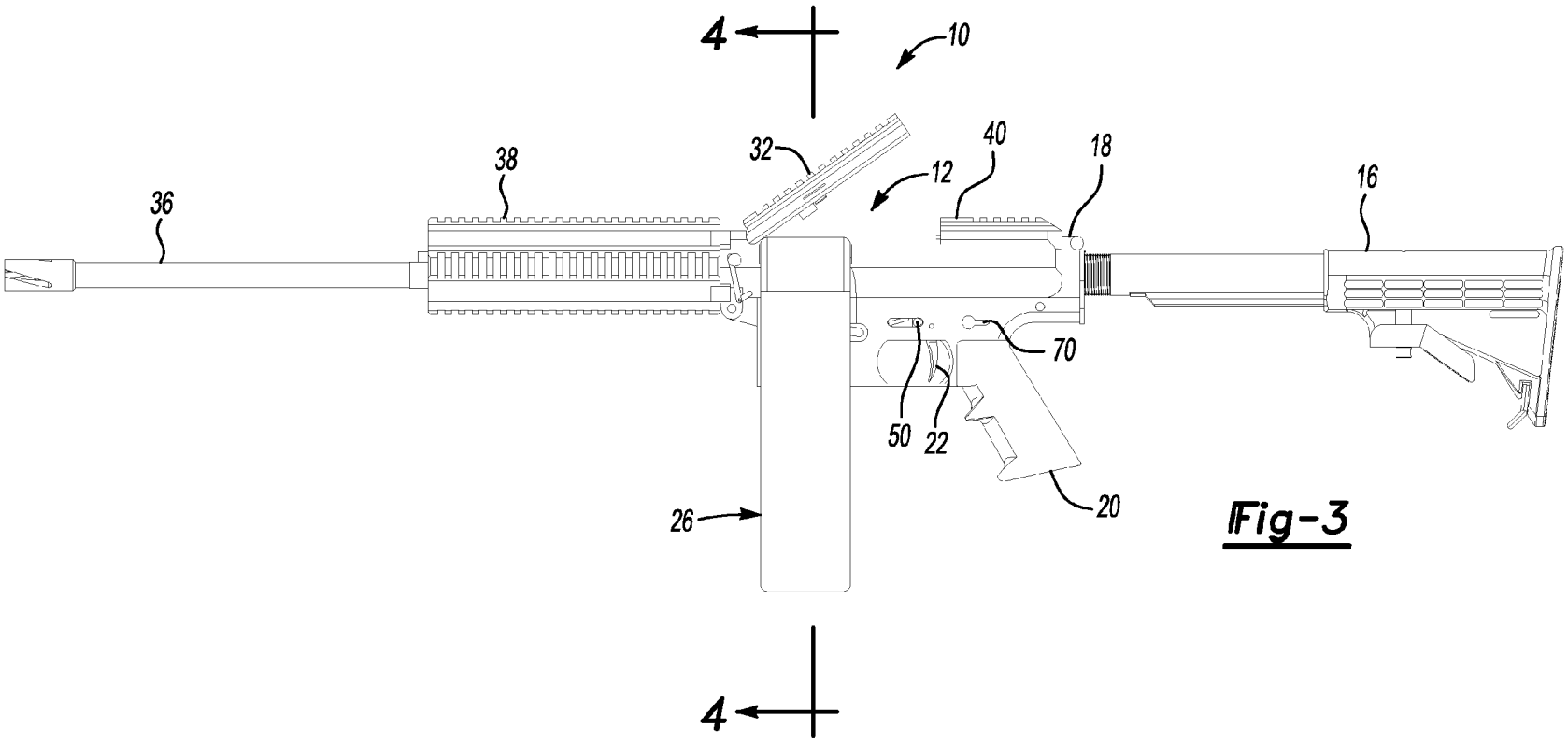
FIG. 3 shows a side view of the assault rifle of the present invention.

An assault rifle of the present invention is generally shown at 10 of FIGS. 1 and 2. The assault rifle 10 includes an ammunition feed 12 that is cooperable with a firing chamber 14 (best shown in FIG. 5). The assault rifle 10 includes a collapsible buttstock 16 with a recoil buffer spring (not shown). The cartridge handle 18 includes a standard grip 20 and trigger 22. An ammunition magazine 24 and a belt feed system 26 are releasably attached to the rifle pin 4 of the grip 20. A magazine release 28 is disposed between the magazine 24 and the grip 20 providing easy access to remove an empty magazine 24 from the rifle 10. The magazine release 28 works in a conventional manner, the depression of which ejects the magazine 24 from the rifle 10.

An empty cartridge ejection port 30 is disposed just above the magazine 24. Cartridges (not shown) are ejected through the port 30 whether received from the magazine 24 or the belt feed system 26. A cover 32 is disposed above the port 30 and is opened a sufficient amount to provide access to belted ammunition 34 shown in schematic in FIGS. 7 and 9. A barrel 36 and grip 38 are positioned forward of the ammunition feed 12 in a known manner. The cover 32, in this embodiment, opens about 35° when a release 40 is actuated. However, it should be understood by those of ordinary skill in the art that the cover need merely open a necessary amount to reasonably access the belted feed system 26.

Figure 4A:
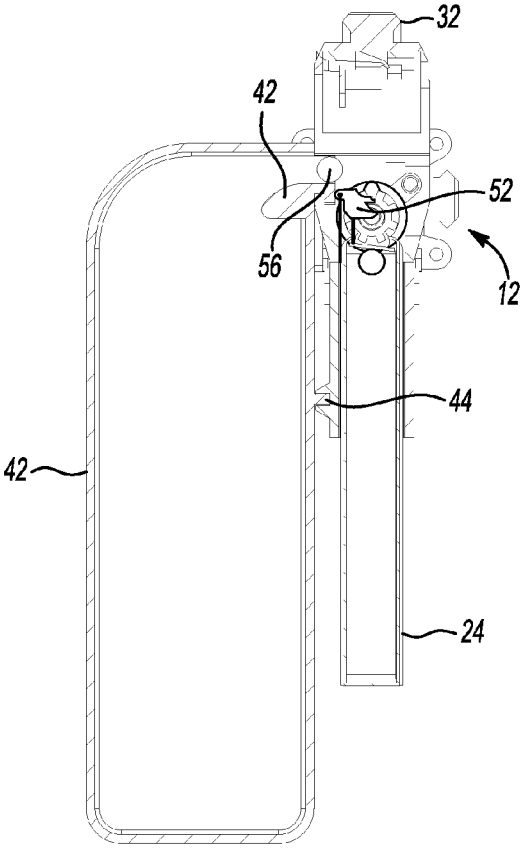
FIGS. 4*a* and 4*b* shows sectional views of the assault rifle through line 4-4 of FIG. 3.
Figure 4B:
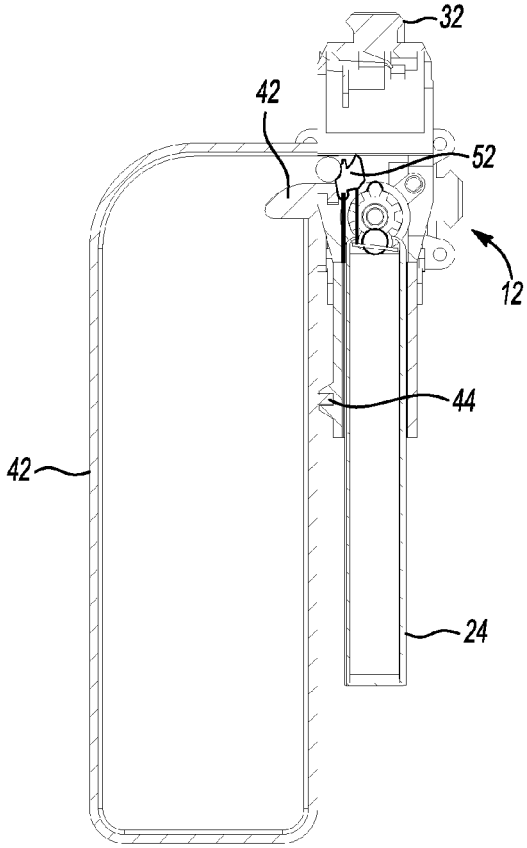

Referring now to FIGS. 4*a* and 4*b*, the belted ammunition is disposed inside an ammunition box 42, which is retained to the rifle 10 by a hook 44 and a tab 46. The belted ammunition 34 is fed into the firing chamber 14 of the assault rifle 10 in a conventional manner when the ammunition feed 12 is set to feed the belted ammunition 34 as will be explained further below. In this embodiment, the rifle 10 is a gas assisted bolt action rifle and makes use of a piston tube 48. However, it should be understood to those of skill in the art that rifles having different firing apparatus can also make use of this inventive feed system. The gas piston 48 is located approximately 50° from the upper surface of the assault rifle 10 to just adjacent the box 42 holding the belted ammunition 34. This allows the ammunition feed 12 to operate from the cover 32.

Figure 5:
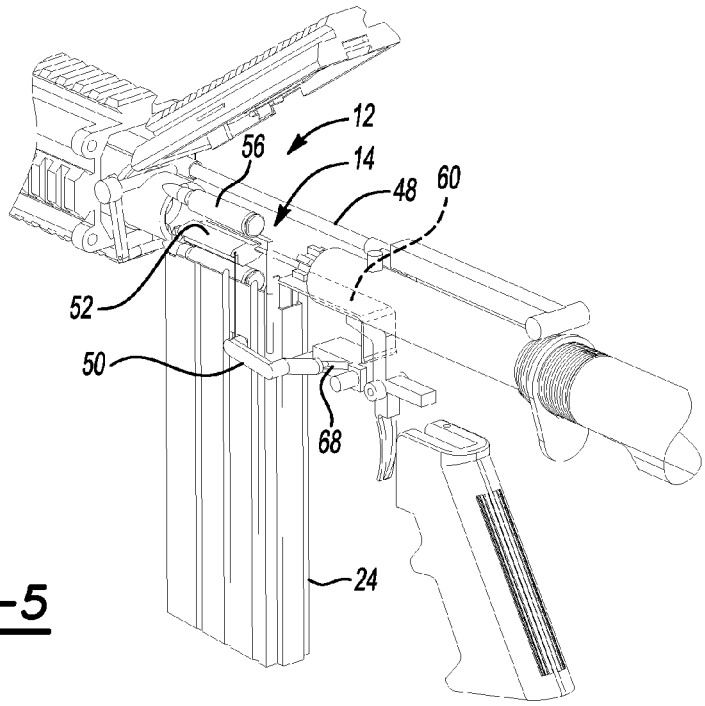
FIG. 5 shows a partial perspective view of the inventive feed system.
Figure 6:
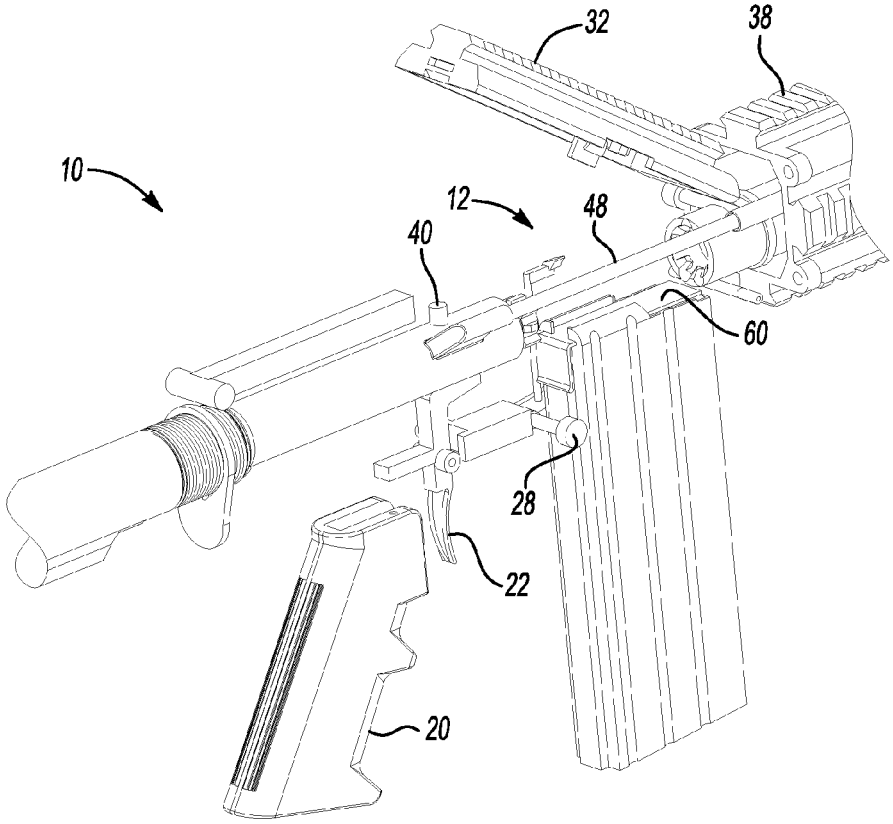
FIG. 6 shows an alternative partial perspective view of the feed system.
Figure 7:
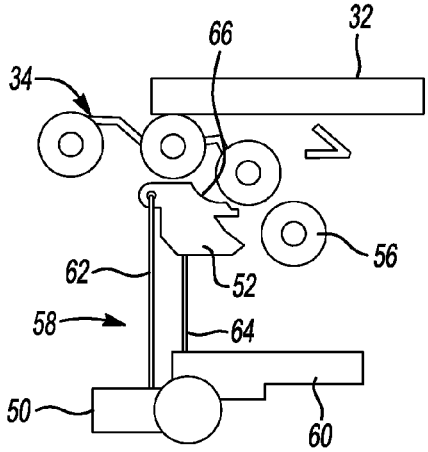
FIG. 7 shows a schematic of the feed system with the pawl in an open position.
Figure 8:
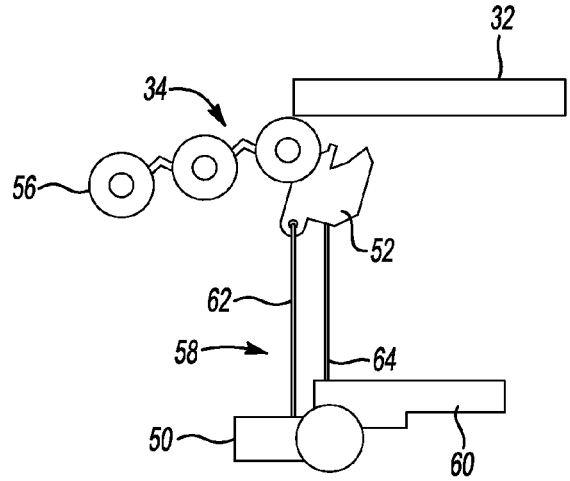
FIG. 8 shows a schematic view of the feed system with the pawl located in a closed position.

A selector 50 is located on a left face of the cartridge handle 18 as can best be seen in FIGS. 2 and 5. The selector 50 switches the ammunition feed 12 between the magazine 25 and the belt feed system 26. FIG. 5 shows a selector 50 with the cartridge handle 18 removed for clarity. The selector 50 actuates a pawl 52 and a magazine cover 54 simultaneously to select between feeding a round 56 of ammunition from the magazine 24 with a belt feed system 26. As best represented in FIG. 7, when the selector 50 is disposed in belt feed position, the pawl 52 is rotated downwardly into a stowed position by link 58. Simultaneously, a magazine cover 60 moves forwardly to cover and seal the magazine 24 preventing rounds 60 from the magazine 24, which are biased upwardly, from entering the firing chamber 14.

The link 58 includes an opening element 62 and a closing element 64 for controlling access to the firing chamber 14 to the belt feed system 26. It should be noted that the magazine cover 54 is fixedly attached to the selector 50 so that moving the selector 50 in a forward direction also moves the magazine cover 60 in a forward direction to cover the magazine 24. Simultaneously, the opening element 62 pivots the pawl 52 into the open position allowing rounds 56 from the belted ammunition 34 to enter the firing chamber 14. The pawl 52 includes a cradle 66 for cradling a round 56 disposed on the belted ammunition 34 when the pawl 52 is rotated into magazine mode closing element 64 for preventing rounds 56 from the belted ammunition 34 from entering the firing chamber 14. In magazine mode, the selector 50 retracts the magazine cover 60 allowing spring biased rounds 56 from the magazine 24 to enter the firing chamber 14. A camming surface 68 assists actuating the pawl 52 between magazine and belt feed position. The camming surface 68 also facilitates lowering the magazine 24 so that rounds disposed in an upper area of the magazine 24 do not interfere with the round 56 entering the firing chamber 14 from the box 42. Therefore, the selector 50 also serves the function of lowering the magazine 24.

A fire switch 70 (best seen in FIG. 2) selects between a safe mode, a single fire, and three shot bursts are full automatic firing. The firing bolt (not shown) is forced rearward by a gas piston 98 and forces the rifle 10 into a counter recoil situation. A bolt engages a lug (not shown) and is held in place until the trigger 22 is pulled during the single fire operation. During burst or full automatic situation, the bolt is moved forward into the firing chamber 14 to fire the next round until the burst is completed or the trigger 22 is released during full automatic mode. Additionally, the rifle 10 is switchable between open bolt firing and closed bolt firing. The switch 70 holds the bolt to fire from an open bolt position when belt feed is selected by the selector 50. When in magazine mode, the bolt returns to the firing chamber 14 without releasing the firing pin (not shown). Therefore, the rifle 10 is now operated in a closed bolt position compatible with firing rounds from the magazine 24.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A feed assembly and assault rifle combination for feeding rounds of ammunition to a firing chamber of said assault rifle, comprising:

an ammunition feed cooperable with a firing chamber, said ammunition feed simultaneously receiving a magazine biased to deliver rounds of ammunition to said firing chamber and a belt feed system for feeding belted rounds of ammunition to said firing chamber;

a selector interconnected to a feed pawl and a magazine cover, said selector simultaneously actuating said feed pawl and said magazine cover alternately opening and closing said feed pawl and said magazine cover for selectively feeding rounds of ammunition from said belt feed system or said magazine into said firing chamber; and said selector lowering said magazine when actuated to feed rounds of ammunition from said belt feed system.

2. The assembly set forth in claim 1, wherein said feed pawl is connected to said selector by a link, said link including an opening element and a closing element for controlling access to said firing chamber to said belt feed system.

3. The assembly set forth in claim 1, wherein said feed pawl defines a cradle for receiving a round of ammunition from said belt feed system when said feed pawl is dispose in a closed position.

4. The assembly set forth in claim 1, wherein said assault rifle includes a barrel and said magazine cover is movable in a direction along said barrel for controlling access to said firing chamber to said magazine.

5. The assembly set forth in claim 1, wherein said magazine cover seals to said magazine to prevent contamination from entering said magazine when the round of ammunition is discharged.

6. The assembly set forth in claim 1, further including a camming surface translating motion to said feed pawl and said magazine cover when said selector is actuated for actuating said feed pawl between magazine and belt feed position.

7. The assembly set forth in claim 1, wherein said belt feed system includes an ammunition box for retaining said belt feed system for feeding belted rounds of ammunition toward said feed pawl and into said firing chamber.

8. The assembly set forth in claim 1, wherein said magazine is biased toward said firing chamber and the rounds of ammunition disposed in said magazine are biased into the firing chamber when said feed pawl is closed preventing the belted rounds of ammunition from said belt feed system from entering the firing chamber and said magazine cover is disposed in an open position.

9. The assembly set forth in claim 1, wherein said assault rifle is switchable between open bolt firing and close bolt firing.

* * * * *